US011193399B2

(12) United States Patent
Keefover et al.

(10) Patent No.: US 11,193,399 B2
(45) Date of Patent: Dec. 7, 2021

(54) VARIABLE CAMSHAFT TIMING ASSEMBLY

(71) Applicant: BorgWarner, Inc., Auburn Hills, MI (US)

(72) Inventors: Robert Keefover, Lake Orion, MI (US); Brian Thomas Kenyon, McGraw, NY (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 16/697,322

(22) Filed: Nov. 27, 2019

(65) Prior Publication Data

US 2020/0165943 A1 May 28, 2020

Related U.S. Application Data

(60) Provisional application No. 62/771,861, filed on Nov. 27, 2018.

(51) Int. Cl.

| | |
|---|---|
| ***F01L 1/344*** | (2006.01) |
| ***F01L 1/047*** | (2006.01) |
| *F02D 13/02* | (2006.01) |

(52) U.S. Cl.

CPC ..... *F01L 1/3442* (2013.01); *F01L 1/047* (2013.01); *F02D 13/0203* (2013.01)

(58) Field of Classification Search

CPC ..... F01L 1/352; F01L 1/3442; F01L 1/344; F01L 1/047; F01L 2001/34486; F01L 2001/34496; F02D 13/0203

USPC ..... 123/90.15, 90.16

See application file for complete search history.

(56) References Cited

U.S. PATENT DOCUMENTS

| | | | | |
|---|---|---|---|---|
| 5,417,186 | A | 5/1995 | Elrod et al. | |
| 6,044,816 | A | 4/2000 | Buck et al. | |
| 6,253,719 | B1 | 7/2001 | Methley | |
| 7,536,986 | B2 | 5/2009 | Schneider | |
| 7,866,293 | B2 | 1/2011 | Clever et al. | |
| 7,938,090 | B2 | 5/2011 | Lancefield et al. | |
| 8,051,818 | B2 * | 11/2011 | Myers | F01L 1/3442 123/90.17 |
| 8,113,159 | B2 | 2/2012 | Myers et al. | |
| 8,122,863 | B2 | 2/2012 | Myers | |

(Continued)

FOREIGN PATENT DOCUMENTS

| | | | |
|---|---|---|---|
| EP | 3141711 | A1 | 3/2017 |
| GB | 2401163 | A | 11/2004 |

*Primary Examiner* — Charles G Freay
*Assistant Examiner* — Kelsey L Stanek
(74) *Attorney, Agent, or Firm* — Reising Ethington P.C.

(57) ABSTRACT

A variable camshaft timing (VCT) assembly for controlling angular positions of concentric camshafts. The VCT assembly includes an independent VCT device and a dependent VCT device. The independent VCT device is hydraulically- or electrically-actuated. The independent VCT device is coupled with a first concentric camshaft and has a first component that rotates during phasing movements. The first component has a first set of slots therein. The dependent VCT device is coupled with a second concentric camshaft. The dependent VCT device has a second component that lacks rotation during phasing movements, and has multiple phase lugs. The second component has a second set of slots therein. The phase lugs are received in the first set of slots and are received in the second set of slots.

19 Claims, 9 Drawing Sheets

(56) References Cited

U.S. PATENT DOCUMENTS

| | | | | |
|---|---|---|---|---|
| 8,146,551 | B2 | 4/2012 | Pluta | |
| 8,191,521 | B2 | 6/2012 | Kandolf et al. | |
| 8,201,528 | B2 * | 6/2012 | Knecht | F01L 1/3442 123/90.17 |
| 8,256,393 | B2 | 9/2012 | Simpson et al. | |
| 8,261,705 | B2 | 9/2012 | Lancefield et al. | |
| 8,336,512 | B2 | 12/2012 | Myers et al. | |
| 8,375,906 | B2 | 2/2013 | Myers et al. | |
| 8,522,737 | B2 | 9/2013 | Yokoyama et al. | |
| 8,596,236 | B2 | 12/2013 | Chung et al. | |
| 8,677,960 | B2 | 3/2014 | Knecht et al. | |
| 8,695,545 | B2 | 4/2014 | Tateno | |
| 8,978,605 | B2 | 3/2015 | Friedrichs | |
| 9,297,281 | B2 | 3/2016 | Sisson et al. | |
| 9,297,283 | B2 | 3/2016 | Schafer et al. | |
| 9,366,159 | B2 | 6/2016 | Wigsten et al. | |
| 9,506,379 | B2 | 11/2016 | Dupuis | |
| 9,512,747 | B2 | 12/2016 | Kim | |
| 9,638,306 | B2 | 5/2017 | Schafer et al. | |
| 9,797,277 | B2 | 10/2017 | Chung et al. | |
| 9,840,942 | B2 | 12/2017 | Zwahr et al. | |
| 10,612,429 | B1 * | 4/2020 | Shamie | F01L 1/344 |
| 2005/0051121 | A1 | 3/2005 | Smith | |
| 2005/0056249 | A1 | 3/2005 | Heinze et al. | |
| 2008/0196681 | A1 | 8/2008 | Lancefield et al. | |
| 2010/0235067 | A1 * | 9/2010 | Nomura | F02D 13/0238 701/103 |
| 2013/0092114 | A1 | 4/2013 | Pietsch et al. | |
| 2014/0190434 | A1 | 7/2014 | Bayrakdar | |
| 2015/0068474 | A1 | 3/2015 | Kim et al. | |
| 2017/0254232 | A1 | 9/2017 | Stays | |
| 2019/0368389 | A1 * | 12/2019 | Burke | F01L 1/3442 |
| 2020/0149439 | A1 * | 5/2020 | Brown | F16H 53/04 |

* cited by examiner

VARIABLE CAMSHAFT TIMING ASSEMBLY

CROSS-REFERENCE TO RELATED APPLICATIONS

This patent application claims the benefit of priority from U.S. Provisional Patent Application No. 62/771,861 filed Nov. 27, 2018, the entire contents of which are hereby incorporated by reference.

TECHNICAL FIELD

The present application relates to internal combustion engines (ICEs) and, more particularly, to variable camshaft timing (VCT) technologies equipped on ICEs.

BACKGROUND

Internal combustion engines (ICEs) use one or more camshafts to open and close intake and exhaust valves in response to cam lobes selectively actuating valve stems as the camshaft(s) rotate and overcome the force of valve springs that keep the valves seated. The shape and angular position of the cam lobes can impact the operation of the ICE. In the past, the angular position of the camshaft relative to the angular position of the crankshaft was fixed. But it is now possible to vary the angular position of the camshaft relative to the crankshaft using variable camshaft timing (VCT) technologies. VCT can be implemented using VCT devices (sometimes referred to as camshaft phasers) that change the angular position of the camshaft relative to the crankshaft. These camshaft phasers can be hydraulically- or electrically-actuated, and are typically directly attached to one end of the camshaft.

Concentric camshafts including an inner camshaft and an outer camshaft can be used to vary the angular position of the inner camshaft relative to the crankshaft and the outer camshaft relative to the crankshaft. One VCT device can be coupled with one of the concentric camshafts (the inner camshaft or outer camshaft) to change the angular position of that camshaft relative to the crankshaft, and another VCT device can be coupled with the other of the concentric camshafts to change the angular position of the other camshaft relative to the crankshaft. The use of two VCT devices that each independently controls the angular position of a camshaft relative to the crankshaft can increase the overall axial length of the VCT assembly. In certain applications, it would be helpful to reduce the axial length of the VCT assembly and hence decrease the cost and complexity of the VCT assembly.

SUMMARY

In one implementation, a variable camshaft timing (VCT) assembly for controlling angular positions of camshafts may include an independent VCT device and a dependent VCT device. The independent VCT device is coupled with a first camshaft and has a first component that rotates during phasing movements of the VCT assembly. The first component has a first set of slots that reside therein. The dependent VCT device is coupled with a second camshaft. The dependent VCT device has a second component that lacks rotation during phasing movements of the VCT assembly. The second component has a second set of slots that reside therein. The dependent VCT device also has multiple phase lugs. The phase lugs are received in the first set of slots and are received in the second set of slots. During control of the angular positions of the first and second camshafts, the phase lugs are urged to move along the first and second sets of slots by way of the first component.

DETAILED DESCRIPTION

A variable camshaft timing (VCT) assembly is used in an internal combustion engine (ICE) and employed to control the angular positions of first and second camshafts of the ICE. The VCT assembly is equipped with a single source of actuation—hydraulic actuation or electric actuation—to make angular adjustments to the first and second camshafts relative to the ICE's crankshaft for advancing and retarding the opening and closing movements of the ICE's intake and exhaust valves. The single source of actuation differs from previous VCT technologies for camshafts which commonly involved two sources of actuation. With the single source, the first and second camshafts exhibit a dependent phase relationship, but one that in certain implementations is a non-fixed and non-linear phase relationship. And because the VCT assembly has a single actuation source rather than two, the VCT assembly more readily satisfies packaging demands which can oftentimes be inflexible in certain applications, especially in automotive applications with regards to overall axial lengths of ICEs. Further, as used herein, the terms axially, radially, and circumferentially, and their related grammatical forms, are used in reference to the generally circular shape of the shown VCT assembly and some of its components. In this sense, axially refers to a direction that is generally along or parallel to a central axis of the circular shape, radially refers to a direction that is generally along or parallel to a radius of the circular shape, and circumferentially refers to a direction that is generally along or in a similar direction as a circumference of the circular shape.

Figure 1:
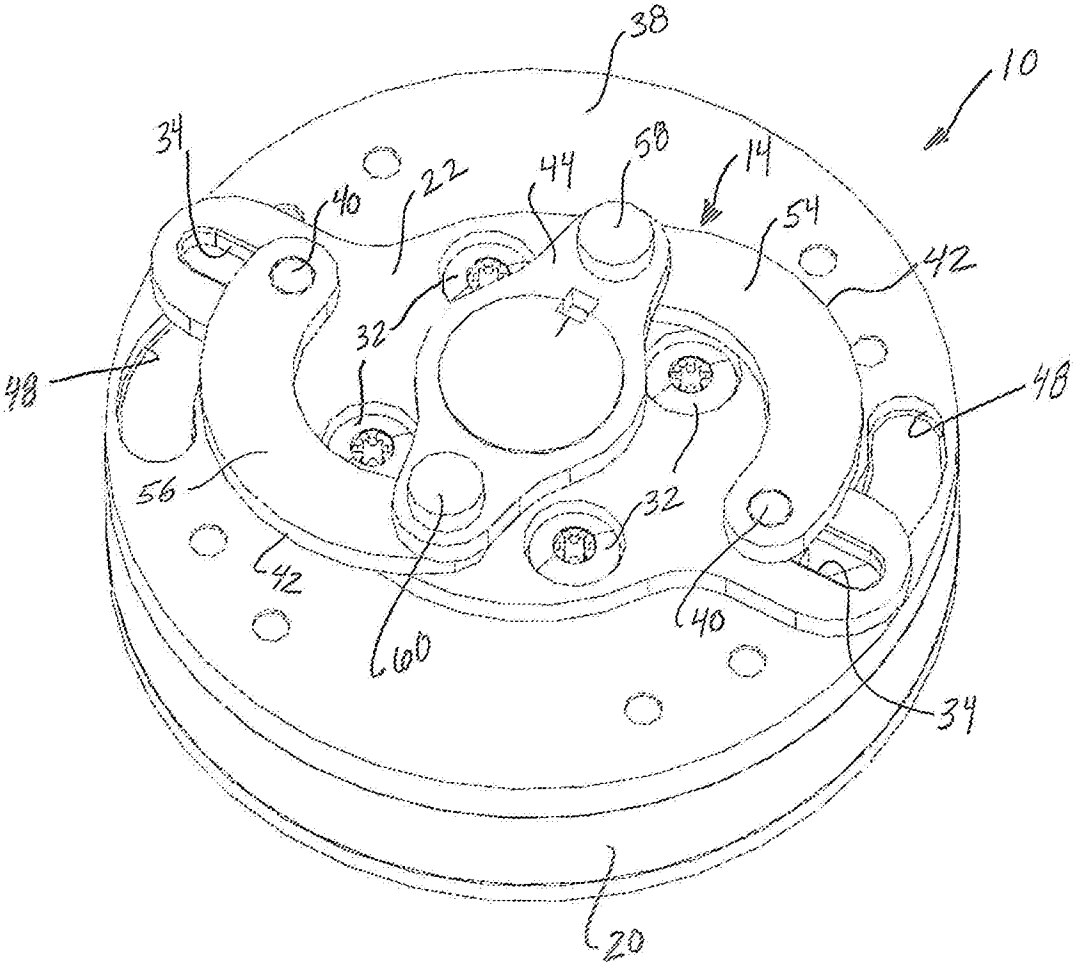
FIG. 1 is a perspective view depicting an implementation of a variable camshaft timing (VCT) assembly.

ICEs use reciprocating pistons linked to a crankshaft. The pistons move within cylinders in response to controlled combustion of air and fuel in the presence of a spark in combustion chambers. The control of the combustion is in part regulated by opening and closing intake and exhaust valves using rotating camshafts. The camshafts rotate relative to the crankshaft and, during rotation, the cams open and close intake and exhaust valves at specified times relative to the delivery of the spark to the combustion chambers of the cylinders. ICEs can implement multiple camshafts in different ways. For example, some ICEs use multiple camshafts, dedicating one camshaft for controlling the operation of intake valves and another camshaft for controlling the operation of exhaust valves. And in some instances, the intake valve camshaft and the exhaust valve camshaft are concentrically situated relative to each other. Concentrically situated camshafts include a first concentric camshaft and a second concentric camshaft that can change angular position relative to each other. Concentric camshafts are known by those skilled in the art, an example of which is shown in FIG. 1 of U.S. Pat. No. 8,186,319 and described in column 6, lines 10-53; the contents of that portion of U.S. Pat. No. 8,186,319 are incorporated by reference.

Figure 3:
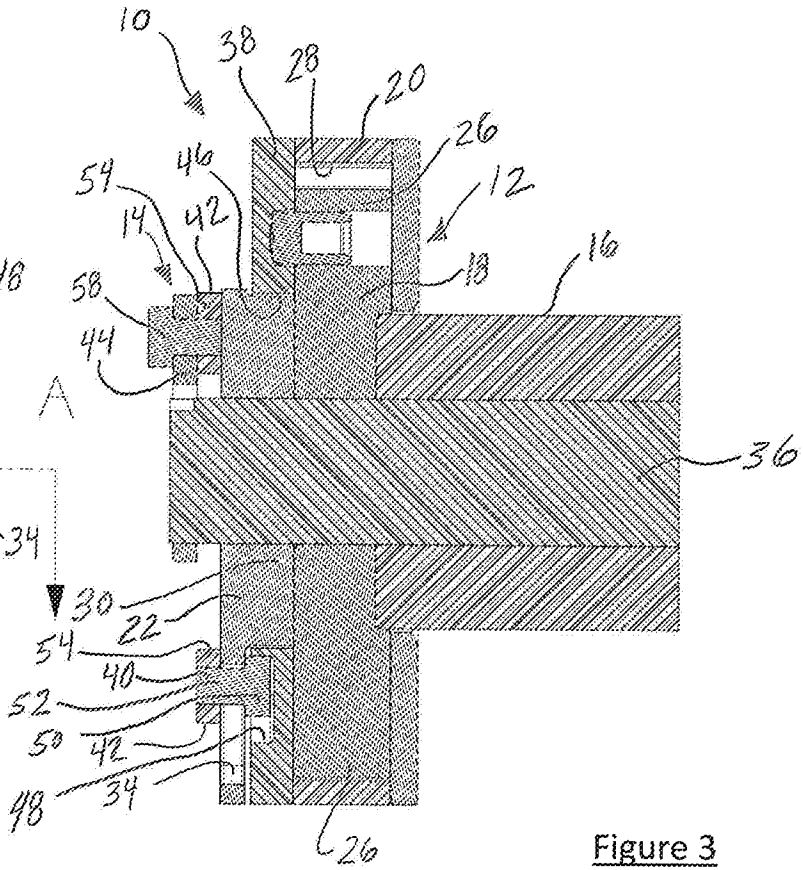
FIG. 3 is a sectional view of the VCT assembly taken at arrowed lines A-A in FIG. 2.
Figure 2:
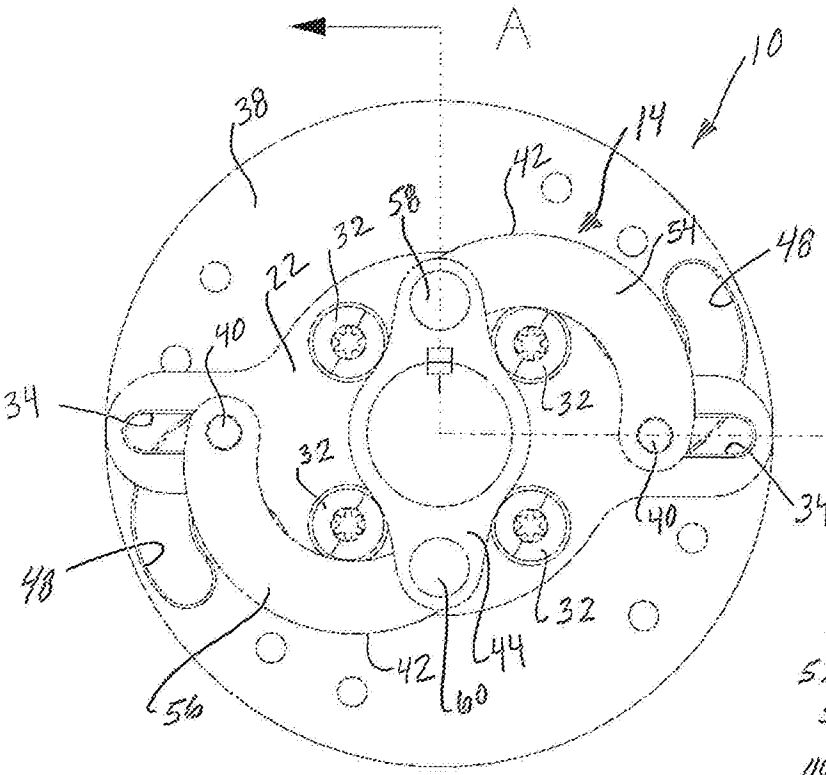
FIG. 2 is a front view of the VCT assembly.
Figure 4:
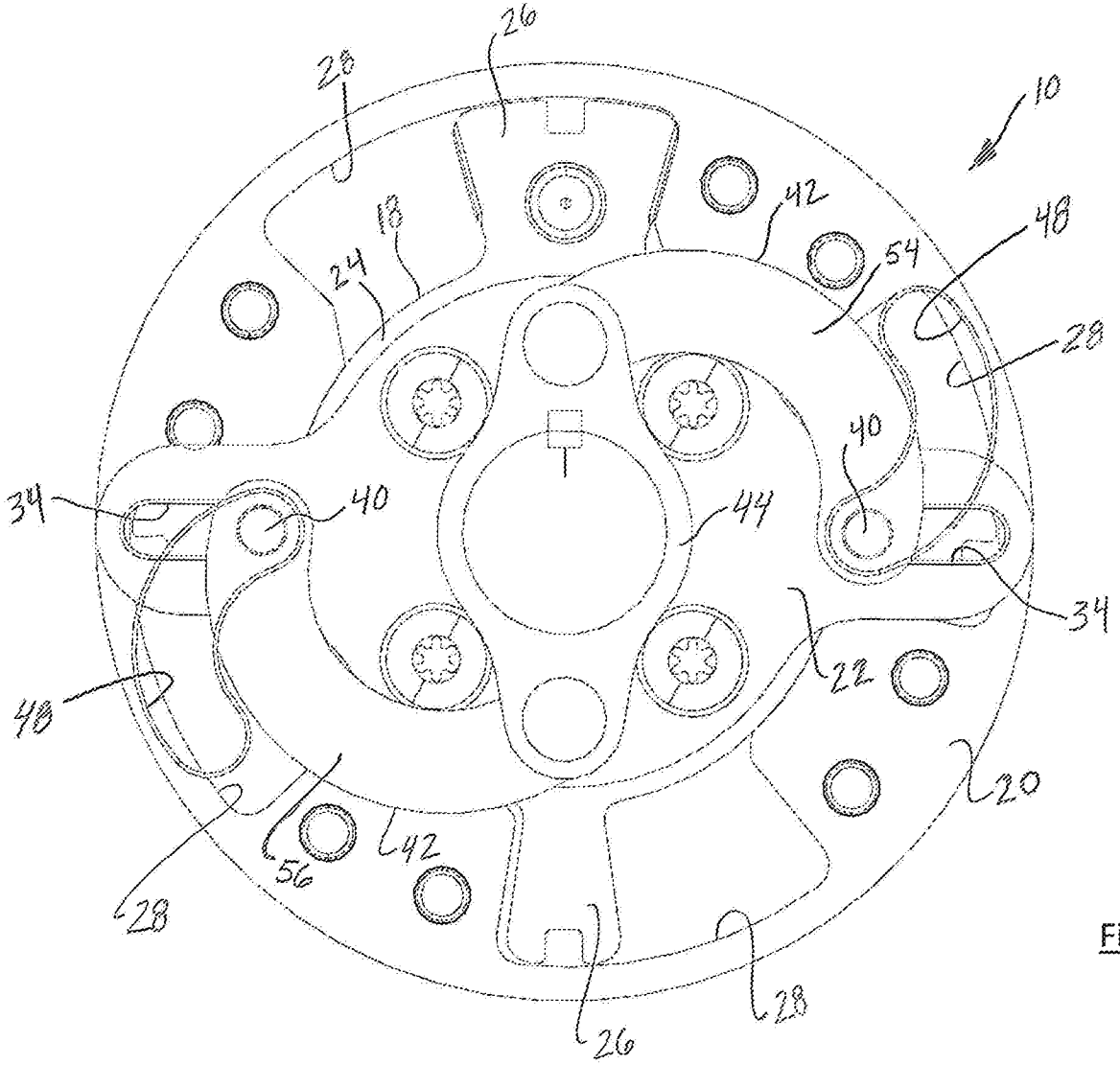
FIG. 4 is a front view of the VCT assembly with certain internal components visible, and showing the VCT assembly in one state.

With reference to FIGS. 1-3, a VCT assembly 10 can have different designs, constructions, and components in different implementations. In the implementation here, the VCT assembly 10 includes an independent VCT device 12 and a dependent VCT device 14. The independent VCT device 12 transmits rotational drive output to a first concentric camshaft 16 which, in the example presented, is an outer concentric camshaft; still, in other implementations the first concentric camshaft could be an inner concentric camshaft. The independent VCT device 12 of the figures is a hydraulically-actuated camshaft phaser, but could be an electrically-actuated camshaft phaser in other implementations. An example of a hydraulically-actuated camshaft phaser is described in U.S. Pat. No. 8,356,583, the contents of which are hereby incorporated by reference; and implementations of electrically-actuated camshaft phasers can be found in U.S. Patent Application Publication No. 2017/0248045 and U.S. patent application Ser. No. 16/155,125, the contents of which are hereby incorporated by reference. Since this implementation involves hydraulic actuation, the independent VCT device 12 includes a rotor 18, a housing 20, and a first component or plate 22. Turning now to FIG. 4, the rotor 18 has a hub 24 and multiple vanes 26 spanning radially outwardly from the hub 24. The rotor 18 has a rigid coupling to the first concentric camshaft 16 on one axial side, and has a rigid coupling to the plate 22 on its other axial side, as best shown by FIG. 3. By these rigid couplings, rotation of the rotor 18 causes rotation of the first concentric camshaft 16 and rotation of the plate 22. The housing 20 has a camshaft sprocket (not specifically shown) and partly defines multiple fluid chambers 28. The camshaft sprocket has external gear teeth that are engaged by an endless loop, such as a chain, that further engages a crankshaft sprocket of the accompanying ICE. By way of the chain, rotational motion of the ICE's crankshaft is transferred to the housing 20, causing the housing 20 to rotate as well. The vanes 26 occupy the fluid chambers 28, and the fluid chambers 28 receive pressurized fluid amid use of the VCT assembly 10.

The plate 22 rotates with the rotor 18 and, via interactions with components of the dependent VCT device 14 as subsequently described, prompts the dependent phase relationship between the independent VCT device 12 and the dependent VCT device 14. Referring now to FIGS. 2 and 3, the plate 22, when viewed from the front, generally has a circular shape at its center with a pair of lobe-like shapes spanning radially-outwardly therefrom. In the sectional view of FIG. 3, the plate 22 has an axial extension portion 30 in direct surface-to-surface confrontation with the rotor 18. The rigid coupling between the plate 22 and the rotor 18, in this implementation, are effected via bolts 32. Further, the plate 22 has a first set of slots 34 residing in its structure. The slots 34 can take different forms in different implementations. In the implementation of the figures, the slots 34 span axially and wholly through the plate 22. The first set of slots 34 includes a pair of individual slots situated on opposite sides of the plate 22 with an approximate spacing of one-hundred-and-eighty degrees (180°) from each other and at the lobe-like shapes. With particular reference to FIG. 2, each individual slot of the first set of slots 34 has a generally linear profile and is situated along a radial direction with respect to the circular shape of the plate's center region.

The dependent VCT device 14 receives rotational drive input from the independent VCT device 12 and itself lacks a more immediate and direct actuation source such as the hydraulic or electric actuation source of the independent VCT device 12. In this regard, phasing functionality of the dependent VCT device 14 is set in motion and effected by the independent VCT device 12. The dependent VCT device 14 transmits rotational drive output to a second concentric camshaft 36 (FIG. 3) which, in the example presented, is an inner concentric camshaft; still, in other implementations the second concentric camshaft could be an outer concentric camshaft. With respect to the first concentric camshaft 16, the second concentric camshaft 36 has a radial inward position. Turning again to FIGS. 1-3, in this implementation the dependent VCT device 14 includes a second component or end plate 38, multiple phase lugs 40, a linkage 42, and a hub plate 44.

The end plate 38 has a rigid coupling to the housing 20 and, amid phasing movements of the VCT assembly 10, neither the end plate 38 nor the housing 20 rotate with the plate 22 and rotor 18. Instead, the end plate 38 and the housing 20 lack rotation relative to the plate 22 and the rotor 18 during phasing movements. When viewed from the front, the end plate 38 generally has an annular shape. An opening 46 (FIG. 3) is defined in a central region of the end plate 38 and receives insertion of the axial extension portion 30 of the plate 22. The end plate 38 has a second set of slots 48 residing in its structure. The slots 48 can take different forms in different implementations. In the implementation of the figures, the slots 48 span axially partway through the end plate 38. The second set of slots 48 include a pair of individual slots situated on opposite sides of the end plate 38 with an approximate spacing of one-hundred-and-eighty degrees (180°) from each other. With particular reference to FIG. 2, each individual slot of the second set of slots 48 has a generally arcuate profile. In one specific example, each individual slot of the second set of slots 48 resembles a segment of an Archimedean spiral.

The phase lugs 40 are received in the first set of slots 34 and are received in the second set of slots 48. In this regard, a section of an individual slot 34 always overlaps with a section of an individual slot 48 during phasing movements of the VCT assembly 10. And during phasing movements of the VCT assembly 10, the phase lugs 40 slide and move along the profile extents of the first and second sets of slots 34, 48. The rotation of the plate 22 urges the phase lugs 40 to move along the first and second sets of slots 34, 48, and the movement along the slots 34, 48, in part, brings about the dependent phase relationship between the independent VCT device 12 and the dependent VCT device 14. The phase lugs 40 include a pair of individual phase lugs—a single phase lug for a single slot 34 and slot 48. With particular reference to FIG. 3, each individual phase lug 40 has a head 50 and a shank 52. The head 50 is received in the slot 48, while the shank 52 passes through the slot 34.

The linkage 42 joins the phase lugs 40 with the hub plate 44 and transfers movement from the phase lugs 40 to the hub plate 44. In particular, the sliding movement of the phase lugs 40 is transferred into rotating movement of the hub plate 44 via the linkage 42. The linkage 42 can take different forms in different implementations. In the implementation of the figures, the linkage 42 includes a first link member 54 and a second link member 56. The first and second link members 54, 56 each have a generally arcuate profile, as perhaps demonstrated best by FIG. 2. The first link member 54 has a rigid coupling with one of the phase lugs 40, and likewise the second link member 56 has a rigid coupling with the other of the phase lugs 40. At its other end, the first link member 54 has a pivotal coupling to the hub plate 44 via a first pin 58, and likewise the second link member 56 has a pivotal coupling to the hub plate 44 via a second pin 60. At the pivotal couplings, the first and second link members 54, 56 are hinged and are able to turn thereabout. The hub plate 44 has a direct rigid coupling to the second concentric camshaft 36 whereby the hub plate 44 and second concentric camshaft 36 co-rotate with each other amid phasing movements of the VCT assembly 10.

During operation, the ICE's crankshaft rotates and that rotation is transferred to the housing 20 of the independent VCT device 12 through the endless loop. The independent VCT device 12 transfers the rotational drive to the first and second concentric camshafts 16, 36. The rotor 18 can be angularly displaced relative to the housing 20 thereby changing the angular position of the first concentric camshaft 16 relative to the ICE's crankshaft. Pressurized fluid can be selectively directed to one side of the vanes 26 to move the rotor 18 relative to the housing 20 in one angular direction, or directed to the other side of the vanes 26 to move the rotor 18 relative to the housing 20 in another angular direction. This angular movement can also be referred to as advancing or retarding the angular position between the camshaft(s) and the crankshaft. Or the rotor 18 can maintain its position relative to the housing 20, thus maintaining the phase relationship between the first concentric camshaft 16 and the second concentric camshaft 36.

As the housing 20 rotates, so too do the other components of the independent VCT device 12 and the dependent VCT device 14. A valve (not shown) can control the pressurized fluid to move the rotor 18 in one angular direction, move the rotor 18 in another angular direction, or maintain the angular position of the rotor 18 relative to the housing 20. When the valve directs the rotor 18 to move relative to the housing 20, this angular movement can move the first concentric camshaft 16 relative to the ICE's crankshaft. The movement of the rotor 18 also changes the angular position of the second concentric camshaft 36 relative to the first concentric camshaft 16.

Figure 5:
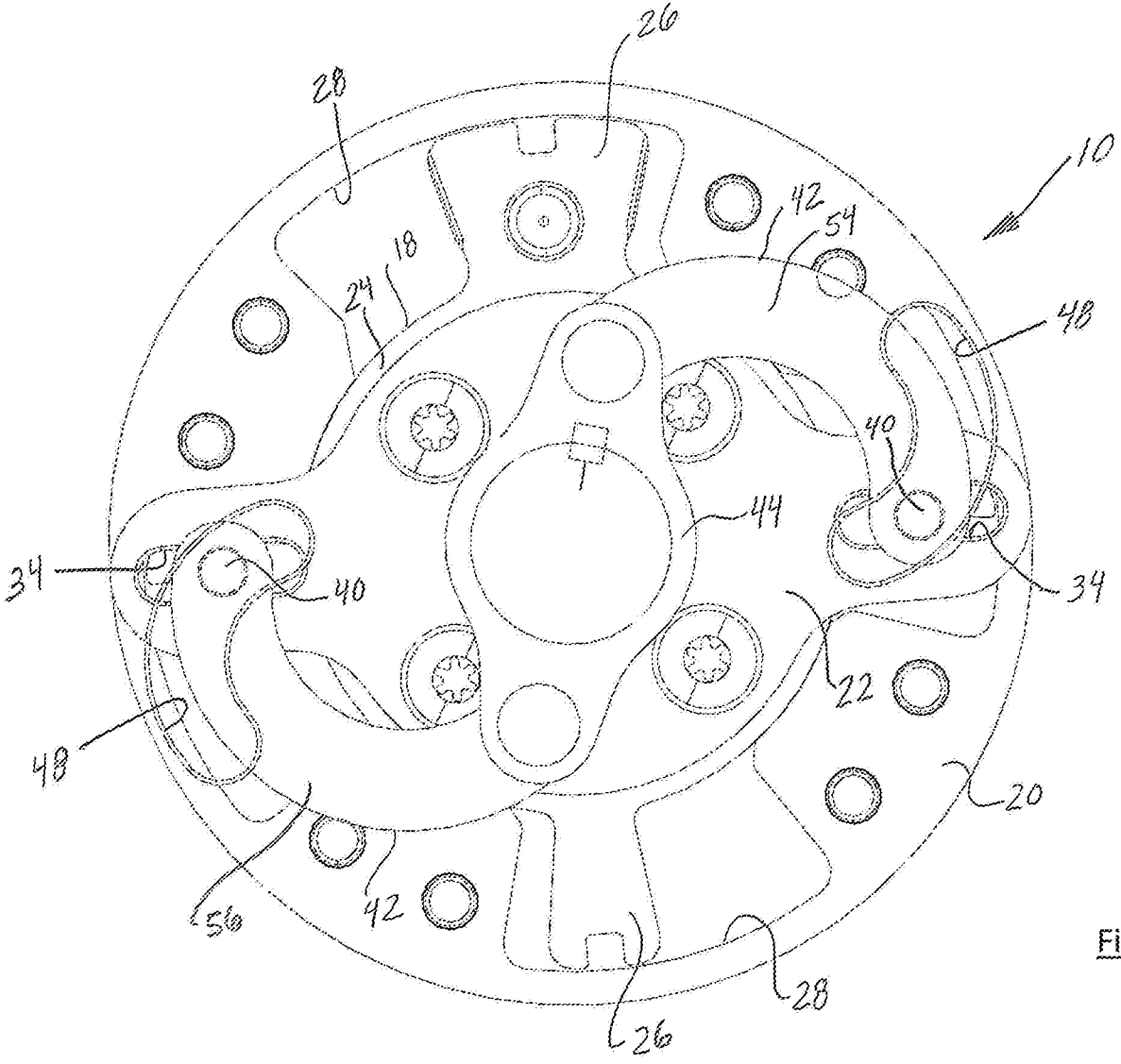
FIG. 5 is a front view of the VCT assembly with certain internal components visible, and showing the VCT assembly in another state.
Figure 6:
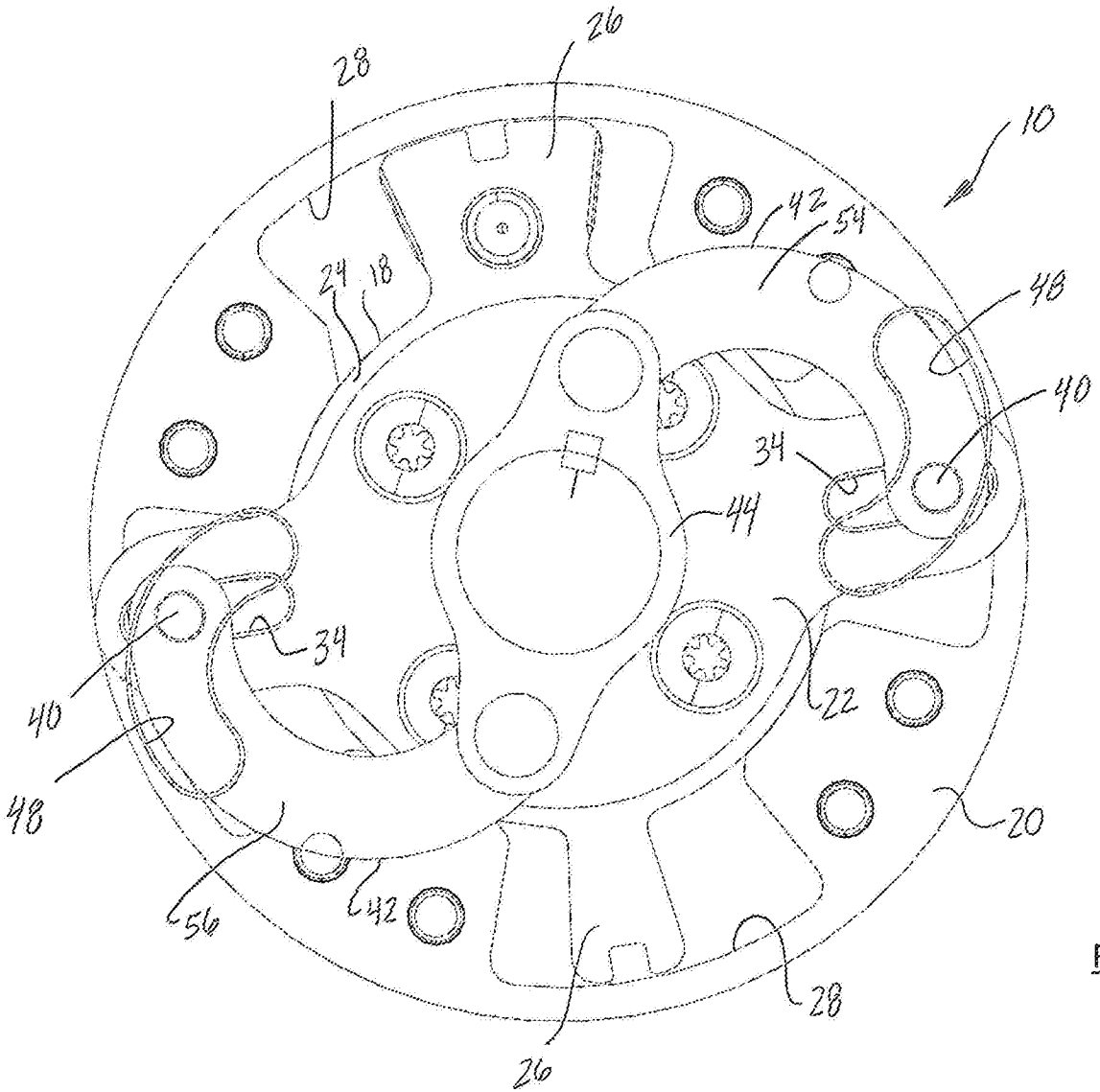
FIG. 6 is a front view of the VCT assembly with certain internal components visible, and showing the VCT assembly in yet another state.
Figure 7:
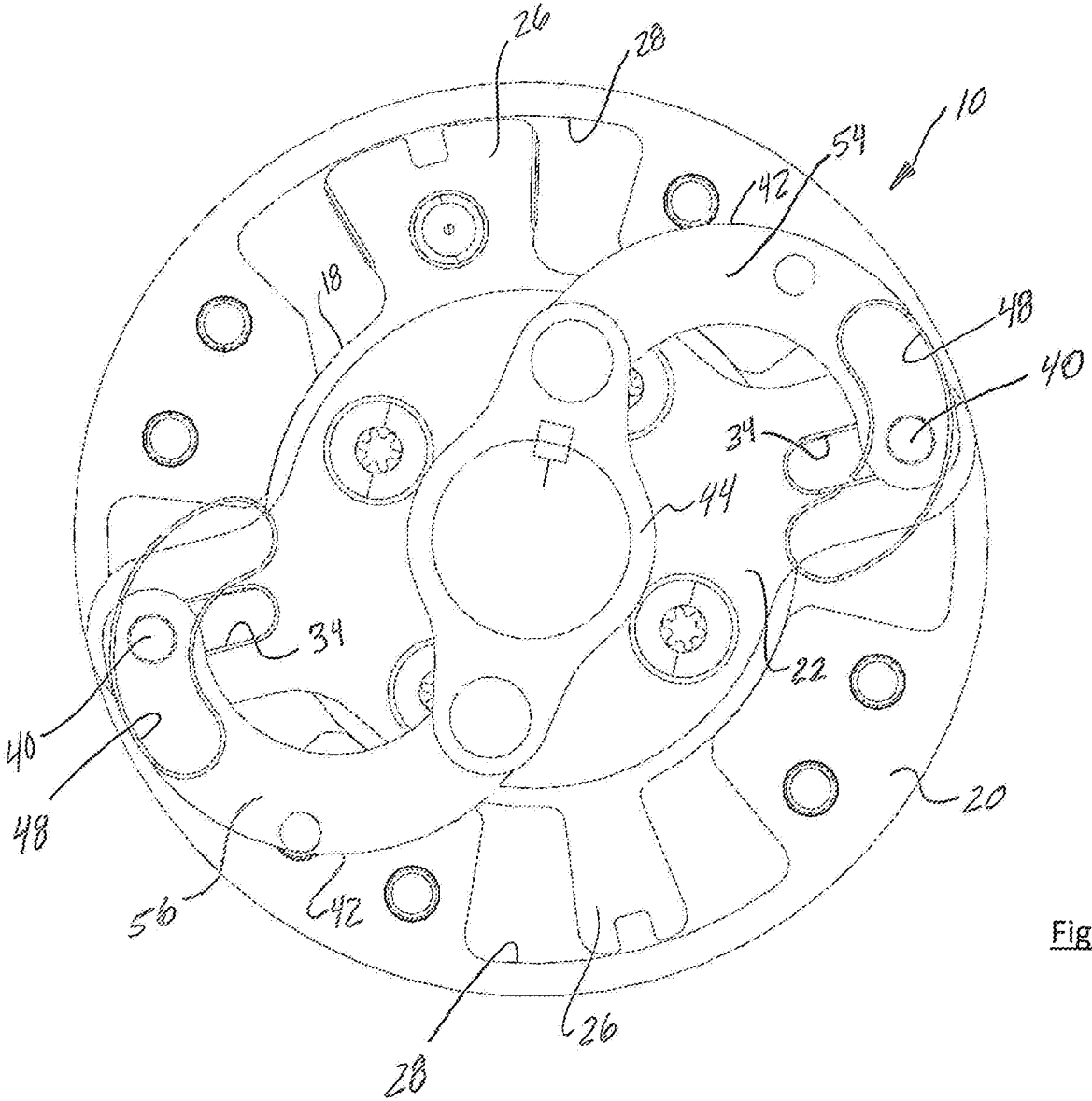
FIG. 7 is a front view of the VCT assembly with certain internal components visible, and showing the VCT assembly in yet another state.
Figure 8:
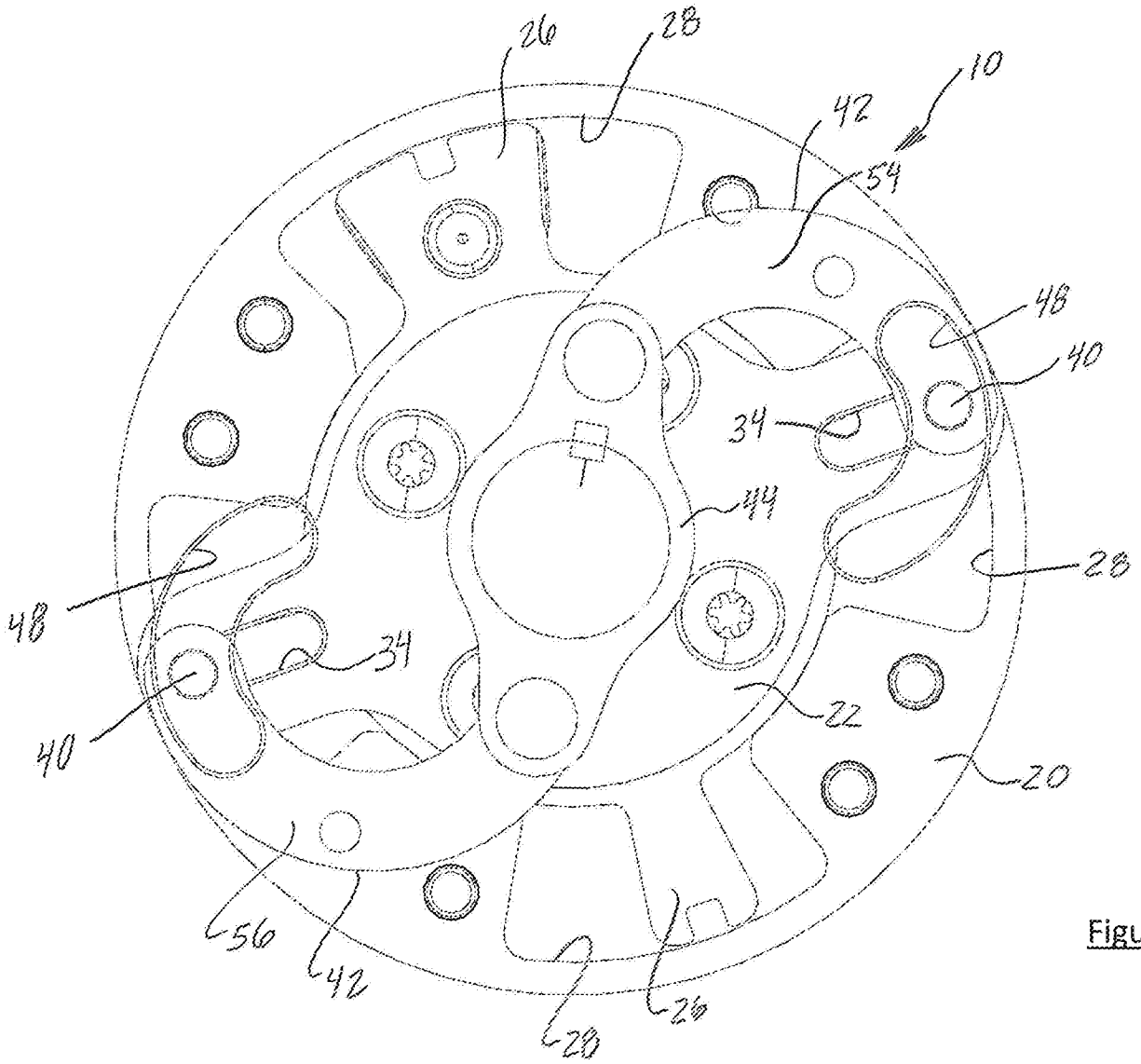
FIG. 8 is a front view of the VCT assembly with certain internal components visible, and showing the VCT assembly in yet another state.
Figure 9:
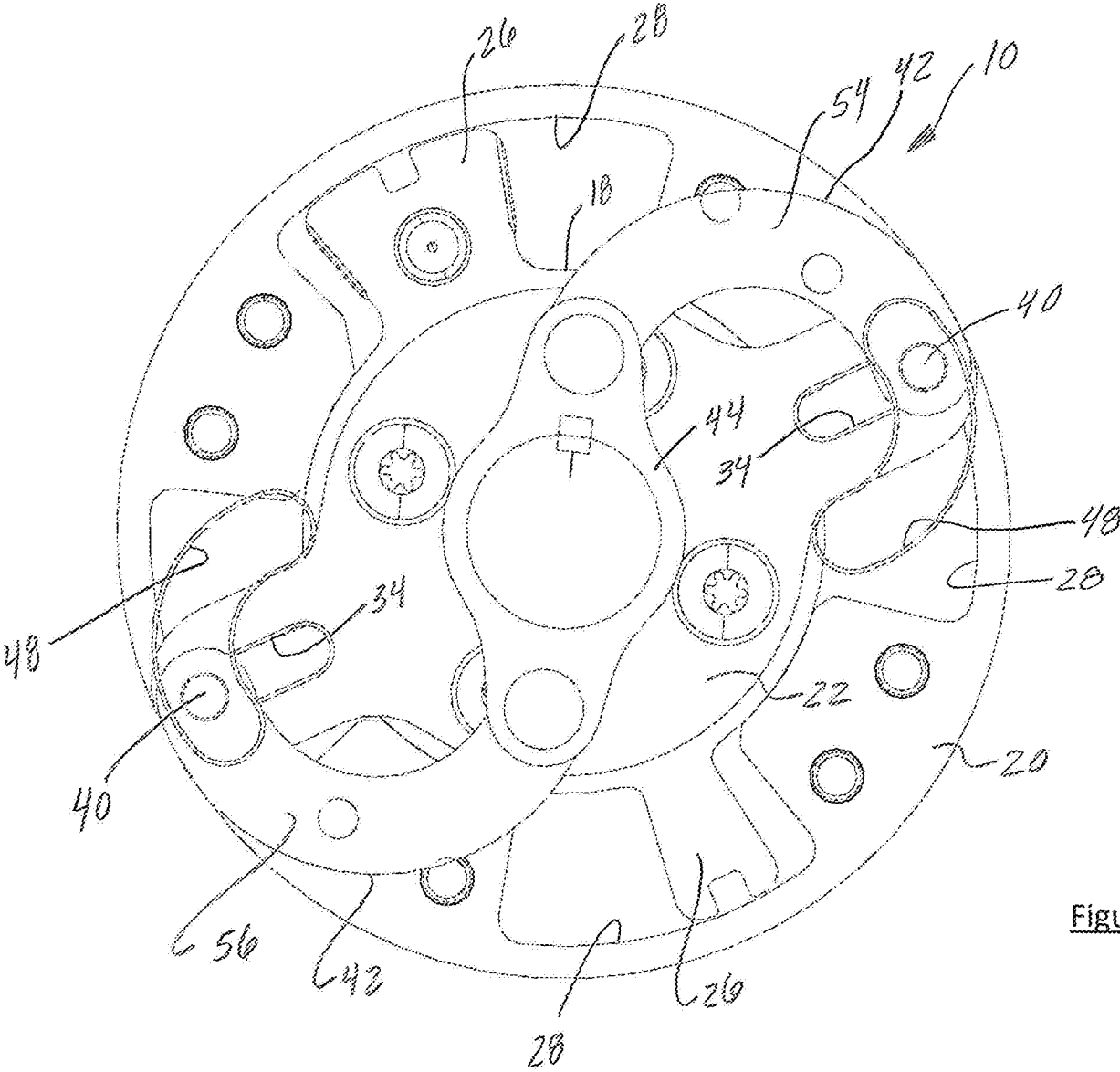
FIG. 9 is a front view of the VCT assembly with certain internal components visible, and showing the VCT assembly in yet another state.
Figure 10:
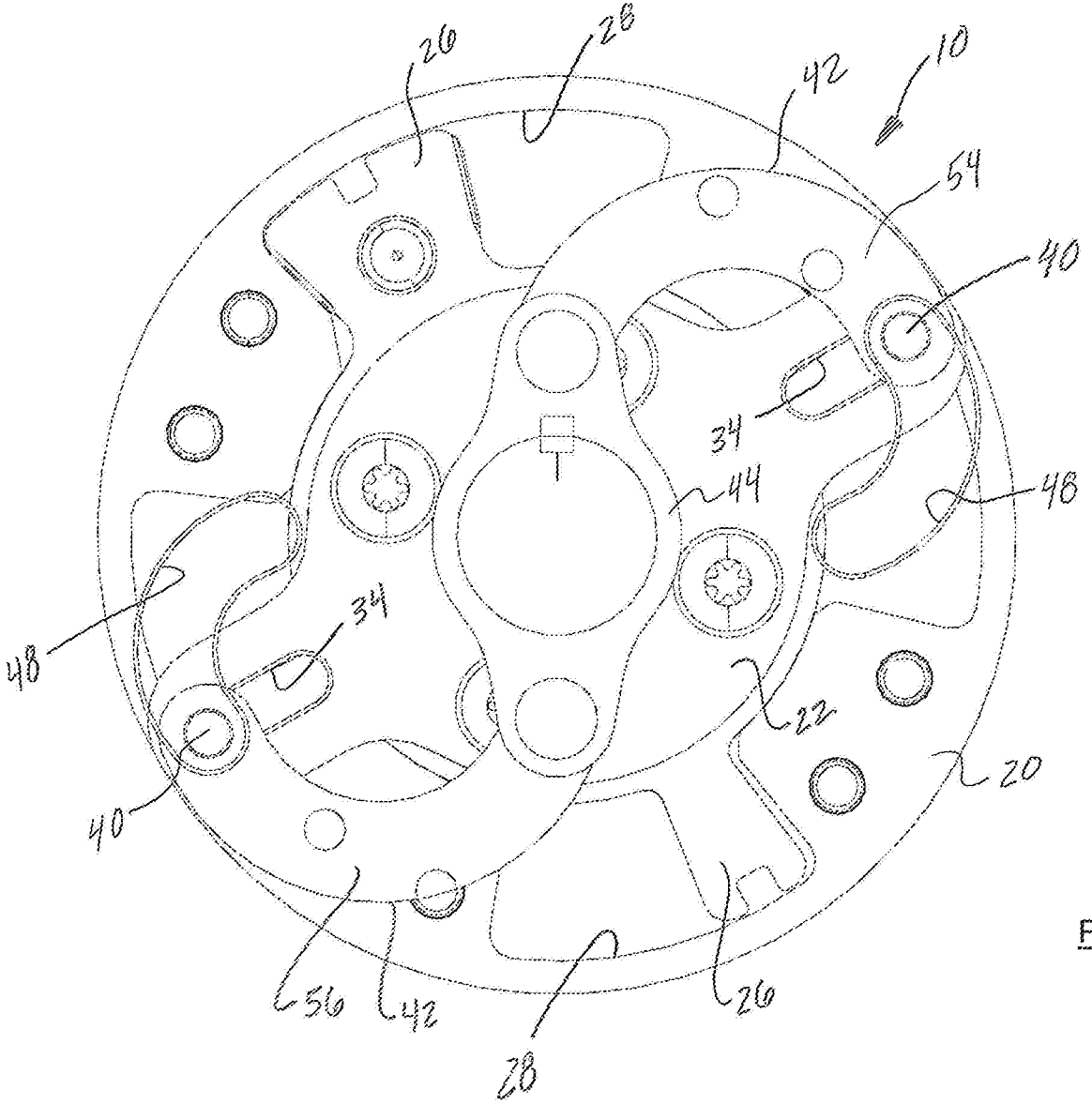
FIG. 10 is a front view of the VCT assembly with certain internal components visible, and showing the VCT assembly in yet another state.

FIGS. 4-10 depict successive states of phasing movements of the VCT assembly 10. In these depictions the end plate 38 is transparent with only an outline of the second set of slots 48 remaining visible in order to show movement of the rotor 18. In FIG. 4, the rotor 18 is set at a first angular position relative to the housing 20, and the phase lugs 40 are located at ends of the first and second sets of slots 34, 48. In FIG. 5, the rotor 18 has moved counterclockwise to a second angular position, and the phase lugs 40 have slid along the profile extents of the first and second sets of slots 34, 48 and are now displaced away from the ends of the slots 34, 48. Further, in FIG. 5, the hub plate 44 has moved clockwise from its previous angular position. In FIG. 6, the rotor 18 has moved farther counter-clockwise to a third angular position, and the phase lugs 40 have slid farther along the profile extents of the first and second sets of slots 34, 48. And in FIG. 6, the hub plate 44 has moved farther clockwise from its previous angular position. In FIG. 7, the rotor 18 has moved farther counter-clockwise to a fourth angular position, and the phase lugs 40 have slid farther along the profile extents of the first and second sets of slots 34, 48. The hub plate 44 lacks rotating movement from the state of FIG. 6 to that of FIG. 7. In FIG. 8, the rotor 18 has moved yet farther counter-clockwise to a fifth angular position, and the phase lugs 40 have slid yet farther along the profile extents of the first and second sets of slots 34, 48. Unlike its previous movements, the hub plate 44 has now moved counterclockwise from the state of FIG. 7 to that of FIG. 8. In FIG. 9, the rotor 18 has moved yet farther counterclockwise to a sixth angular position, and the phase lugs 40 have slid yet farther along the profile extents of the first and second sets of slots 34, 48. And in FIG. 9, the hub plate 44 has moved farther counterclockwise from its previous angular position. Lastly, in FIG. 10, the rotor 18 has moved yet farther counterclockwise to a seventh angular position, and the phase lugs 40 have slid yet farther along the profile extents of the first and second sets of slots 34, 48. And in FIG. 10, the hub plate 44 has moved farther counter-clockwise from its previous angular position and to the angular position it exhibited in the prior state of FIG. 4.

The particular dependent phase relationship between the independent VCT device 12 and the dependent VCT device 14 comes into view from an examination of the successive states of phasing movements of the VCT assembly 10 presented by FIGS. 4-10. The dependent phase relationship is based in part upon the precise profile extents of the first and second sets of slots 34, 48. In other implementations, these profile extents can vary in order to consequently vary the effected dependent phase relationship between the independent VCT device 12 and the dependent VCT device 14. For example, each of the second set of slots 48 could have a profile with a bend approximately midway in its extent and with linear or arcuate profiles on each side of the bend.

Still, other implementations of the VCT assembly are possible. In another implementation, the rotor of the independent VCT device could have the first set of slots residing in its structure (the rotor would thus constitute the first component of the independent VCT device). The plate 22, as previously described, would be absent in this implementation. The first set of slots could include four individual slots spaced equally around the rotor, with each individual slot having a generally linear profile and situated along a radial direction of the rotor. The end plate could have the second set of slots residing in its structure. The second set of slots could include four individual slots spaced equally around the end plate, with each individual slot having a generally arcuate profile. Furthermore, in this implementation a coupler plate could be included as a component of the dependent VCT device. The coupler plate could have a rigid coupling with the second concentric camshaft whereby the coupler plate and second concentric camshaft co-rotate with each other amid phasing movements. The linkage 42 and hub plate 44, as previously described, would be absent in this implementation. The coupler plate could have a third set of slots residing in its structure. The third set of slots could include four individual slots spaced equally around the coupler plate, with each individual slot having a profile with a bend approximately midway in its extent and with linear profiles on each side of the bend. Here, the phase lugs would be received in all of the first set of slots, the second set of slots, and the third set of slots.

In this implementation, as in the previous implementation of the figures, varying the profile extents of one or more or all of the first, second, and third sets of slots would in turn vary the effected dependent phase relationship between the independent VCT device and the dependent VCT device. For instance, the first and third sets of slots could have the same profile extent, and that profile extent could be each individual slot having a generally linear profile and situated along a radial direction of the respective component. Further, in yet another example, the second and third sets of slots could have the same profile extent, and that profile extent could be each individual slot having a generally arcuate profile.

In yet additional implementations, the VCT assembly and its independent and dependent VCT devices could be equipped on other types of camshafts apart from those concentrically arranged as described. For example, a first camshaft and a discrete second camshaft could be arranged in a non-concentric manner with one or more chain, gear, or belt drives situated between them. Still, other types of camshafts are possible.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A variable camshaft timing (VCT) assembly for controlling angular positions of a first camshaft and a second camshaft, the VCT assembly comprising:

an independent VCT device coupled with the first camshaft and having a first component that rotates amid phasing movements of the VCT assembly, the first component having a first set of slots residing therein; and a dependent VCT device coupled with the second camshaft, the dependent VCT device having a second component that lacks rotation amid phasing movements of the VCT assembly and having a plurality of phase lugs, the second component having a second set of slots residing therein, the plurality of phase lugs received in the first set of slots and received in the second set of slots, the dependent VCT device including a linkage connected to the plurality of phase lugs, wherein the linkage includes a first link member connected to a first phase lug of the plurality of phase lugs and includes a second link member connected to a second phase lug of the plurality of phase lugs;

wherein, amid controlling of the angular positions of the first and second camshafts, the plurality of phase lugs are urged to move along the first and second sets of slots via the first component.

2. The VCT assembly of claim 1, wherein the independent VCT device is hydraulically-actuated or electrically-actuated.

3. The VCT assembly of claim 1, wherein the first camshaft is positioned radially outwardly relative to the second camshaft.

4. The VCT assembly of claim 1, wherein the independent VCT device includes a rotor and the first component is a plate coupled to the rotor.

5. The VCT assembly of claim 1, wherein each slot of the first set of slots has a generally linear profile and is situated in a radial direction in the first component.

6. The VCT assembly of claim 1, wherein the second component is an end plate.

7. The VCT assembly of claim 1, wherein each slot of the second set of slots has a generally arcuate profile.

8. The VCT assembly of claim 1, wherein individual slots of the first set of slots have a profile that differs from the profile of individual slots of the second set of slots.

9. The VCT assembly of claim 1, wherein the dependent VCT device includes a hub plate and the linkage has a pivotal coupling to the hub plate.

10. The VCT assembly of claim 1, wherein the first component is a rotor.

11. A variable camshaft timing (VCT) assembly for controlling angular positions of a first camshaft and a second camshaft, the VCT assembly comprising:

a hydraulically-actuated or electrically-actuated camshaft phaser transmitting rotational drive output to the first camshaft and having a first component that rotates amid phasing movements of the VCT assembly, the first component having a first set of slots residing therein; and a second component that lacks rotation amid phasing movements of the VCT assembly and having a plurality of phase lugs, the second component having a second set of slots residing therein, the plurality of phase lugs received in the first set of slots and received in the second set of slots, a linkage connected to the plurality of phase lugs, a hub plate coupled with the second camshaft, the linkage having a pivotal coupling to the hub plate;

wherein, amid controlling of the angular positions of the first and second camshafts, the plurality of phase lugs are urged to move along the first and second sets of slots via the first component.

12. The VCT assembly of claim 11, wherein the first camshaft is positioned radially outwardly relative to the second camshaft.

13. The VCT assembly of claim 11, wherein the hydraulically-actuated or electrically-actuated camshaft phaser includes a rotor and the first component is a plate coupled to the rotor.

14. The VCT assembly of claim 11, wherein each slot of the first set of slots has a generally linear profile and is situated in a radial direction in the first component.

15. The VCT assembly of claim 11, wherein the second component is an end plate.

16. The VCT assembly of claim 11, wherein each slot of the second set of slots has a generally arcuate profile.

17. The VCT assembly of claim 11, wherein individual slots of the first set of slots have a profile that differs from the profile of individual slots of the second set of slots.

18. The VCT assembly of claim 11, wherein the linkage includes a first link member connected to a first phase lug of the plurality of phase lugs and includes a second link member connected to a second phase lug of the plurality of phase lugs.

19. The VCT assembly of claim 11, wherein the first component is a rotor.

* * * * *